United States Patent [19]

Bindernagel et al.

[11] 4,320,646

[45] Mar. 23, 1982

[54] WIRE OR WIRE ROD COOLERS

[75] Inventors: Ali Bindernagel, Wermelskirchen; Ernst O. Blos, Hochdahl; Hans Brauer, Leichlingen, all of Fed. Rep. of Germany

[73] Assignee: Kocks Technik GmbH & Co., Dusseldorf, Fed. Rep. of Germany

[21] Appl. No.: 177,257

[22] Filed: Aug. 11, 1980

[51] Int. Cl.[3] ..... B21B 43/04; B21F 21/00; C21D 8/06

[52] U.S. Cl. ..... 72/201; 140/2; 148/12 B; 266/106

[58] Field of Search ..... 72/66, 201; 140/1, 2; 148/12 B, 153, 155, 156; 266/106; 242/79

[56] References Cited

U.S. PATENT DOCUMENTS

| | | | |
|---|---|---|---|
| 3,490,500 | 1/1970 | Dopper et al. | 140/1 |
| 3,977,224 | 8/1976 | Stubbins | 72/201 |
| 4,064,916 | 12/1977 | Dahmen | 140/2 |
| 4,172,375 | 10/1979 | Rushforth et al. | 140/2 X |
| 4,242,153 | 12/1980 | Vitelli et al. | 148/12 B |

FOREIGN PATENT DOCUMENTS 853664 8/1957 United Kingdom .

*Primary Examiner*—Ervin M. Combs
*Attorney, Agent, or Firm*—Buell, Blenko, Ziesenheim & Beck

[57] ABSTRACT

A cooling conveyor arrangement for rolled wire or wire rod which has left a water cooler has a loop-forming device which deposits the wire in overlapping loops on an air-cooling conveyor. To obtain a shorter cooling path, which is desirable for high-grade steels to reduce the rate of cooling, the loops fall onto a conveyor portion and are carried by a conveyor portion to a coil-forming station where the loops are collected. To obtain a longer cooling path a removable conveyor portion is switched into place so that the loops are carried along a conveyor portion to an opening where they fall onto a conveyor portion. A conveyor portion is swung into alignment with the portion carrying the loops to feed the loops to the coil-forming station.

5 Claims, 5 Drawing Figures

WIRE OR WIRE ROD COOLERS

This invention relates to wire or wire rod coolers and more particularly to a cooling conveyor arrangement for the cooling of hot-rolled wire or wire rod, having a loop-forming device which deposits the wire (or rod) in spread-out, mutually overlapping loops, only one coil-formed station which collects the loops, and a conveyor which conveys the overlapping loops between the loop-forming device and the coil-formed station while the loops therein cool.

In modern rolling mills, rolled wire or wire rod having a sorbitic structure is produced directly from the rolling heat by means of a cooling conveyor arrangement of this kind. For this purpose, the wire is first cooled from the rolling temperature (950 to 1050 degrees Celcius) to approximately 600 to 650 degrees Celcius in a water cooler directly beyond the last rolling stand. At this temperature, the wire enters the loop-forming device which is located at the beginning of an air cooling conveyor and which deposits the wire in spread-out, mutually overlapping loops onto a conveyor. This conveyor can comprise a conveyor belt, a roller bed, or the like. The wire is further cooled at a predetermined rate on the conveyor, static air or correspondingly rapid flowing air being used. The cooled loops are collected to form a compact coil in the coil-forming station at the end of the conveyor.

The characteristic of the cooling of the wire and the level of the temperature of the coil of wire in the coil-forming station are largely determined by the length of the conveyor between the loop-forming device and the coil-forming station. Even though the characteristic of the cooling of the wire is affected by the speed at which the overlapping loops are conveyed on the conveyor and by the rate of flow of the cooling air and by the existing possibilities of radiation of heat to the conveyor, and these factors are also variable, one very quickly encounters limits which cannot be exceeded at an economically justifiable expense. Thus, for example, cooling on a known cooling conveyor arrangement of this kind is too intensive for many types of steel, particularly alloyed and high-alloyed steel such as ball bearing steel. In such cases, switching-off of the blower for the cooling air and covering the conveyor with insulating hoods is insufficient to obtain adequately slow cooling of the wire. The known cooling conveyor arrangements are usually designed for simple structural steels, since these steels usually constitute the largest proportion of the rolling program. Since simple steels require more intensive cooling, the conveyor has to be correspondingly long, this being disadvantageous when cooling alloyed and high-alloyed steels. In the case of specific, special qualities, it is even desirable that the loops which are spread out by the loop-forming device, and which are thereby brought to rest from the rolling speed, should be collected to form a coil in the shortest time, and then to subject this coil to suitable heat treatment or slow cooling.

An object of the invention is to provide a cooling conveyor arrangement of the kind mentioned initially and which is suitable for all qualities or grades of material or which can be rapidly adapted to the different qualities of material at low expense.

In accordance with the invention, the length of the path of the conveyor is variable in that the cooling conveyor arrangement comprises a loop-forming device for depositing the wire or rod in spread-out, mutually overlapping loops, a single coil-forming station for collecting the loops, and a conveyor for conveying the loops between the loop-forming device and the coil-forming station while the loops cool, the effective length of the path of the conveyor being variable in that the loops are guidable onto portions of different lengths of the conveyor by means of at least one transfer conveyor portion which can be selectively put into operation or changed over.

Thus it is possible to influence the intensity of cooling by varying the effective length of the path of the conveyor as well as by the speed of the cooling air and by varying the radiation conditions.

A cooling conveyor is known from German Pat. specification (Offenlegungsschrift) No. 25 24 673 in which the effective length of the path of the conveyor can be shortened to a considerable extent by disposing a second coil-forming station for collecting the loops at a short distance downstream of the loop-forming device, wherein a portion of the conveyor located above this second coil-forming station is removable, so that the oncoming loops drop into this coil-forming station arranged at a short distance downstream of the loop-forming device.

However, this known construction has the disadvantage that a second expensive coil-forming station has to be provided, and the devices for conveying away the coils also have to be arranged at two coil-forming stations. Moreover, this known construction is less adaptable to qualities of material in which the intensive cooling is too great along the long path and the small amount of cooling is insufficient along the short path, a medium length of path being required. A further coil-forming station would have to be provided in such cases. This is uneconomical and would involve high capital expenditure and would take up a large amount of space. In contrast to this, the cooling arrangement in accordance with the invention is considerably simpler, less expensive and more economical, since it requires only a single coil-forming station, and the wire loops are only guided along paths of different lengths by using different portions of the conveyor by means of the transfer portions which can be selectively put into operation or changeover.

In one embodiment of the invention, the transfer portion comprises a selectively removable portion of the conveyor or is exchangeable for a portion having a fall-through opening for the loops, another portion of the conveyor being provided below the latter. The conveyor of the previously mentioned known construction also has removable portions, although only above the coil-forming station and not in order to be able to load another portion of the conveyor with the wire loops.

Furthermore, in another embodiment the transfer portion comprises a pivotable switch portion which is selectively alignable with various portions of the conveyor. This embodiment of the invention has the advantage that the conveyor occupies a single plane.

The invention is further described, by way of example with reference to the drawings, in which.

Figure 1:
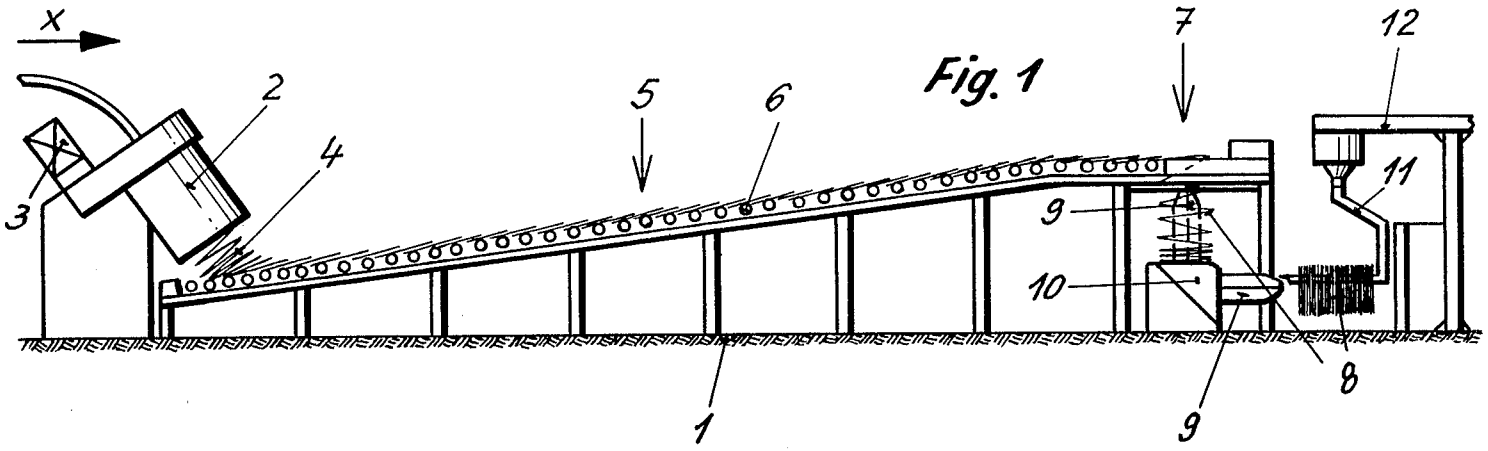
FIG. 1 is a side elevation of a known air cooling conveyor arrangement.

Referring to FIG. 1, wire or wire rod from a water cooler (not illustrated) is fed in the direction of the arrow X to a loop-forming device 2 disposed on a foundation 1. The loop-forming device 2 is driven by a motor 3 and deposits the wire in the form of mutually overlapping, spread-out loops onto a conveyor 5 which has a large number of driven rollers 6.

The wire loops 4 are fed by way of the conveyor 5 to a coil-forming station 7 where the loops are collected to form a coil 8. On their way to the coil-forming station, the loops 4 give up a greater or lesser proportion of their heat to the ambient air.

The coil-forming station 7 collects the wire loops 4 on receiving mandrels 9 which, by rotation of their common base 10 about an axis inclined through 45 degrees relative to the horizontal, are interchangeable. The vertical mandrel 9 collects the loops 4 dropping from the conveyor 5. The coil 8 which is formed is pushed from the respective horizontal mandrel 9 onto a C-shaped hook 11 of a hook-type conveying means 12.

Figure 2:
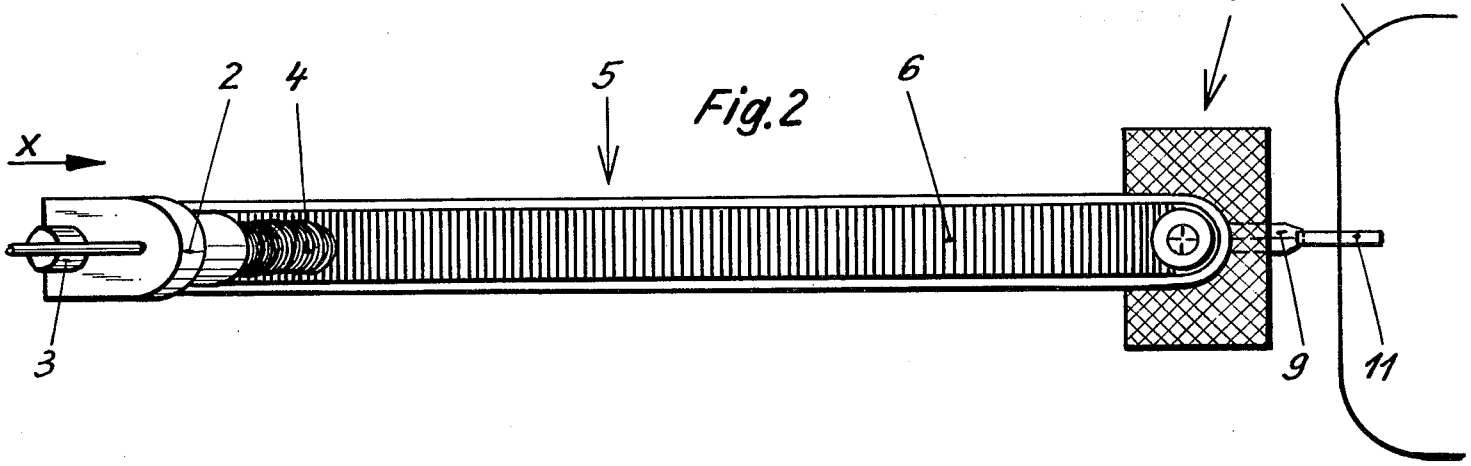
FIG. 2 is a plan view of the known air cooling arrangement of FIG. 1.

FIG. 2 shows that, in this known construction, the loops 4 are conveyed from the loop-forming device 2 to the coil-forming station 7 only along a path of fixed length.

Figure 3:
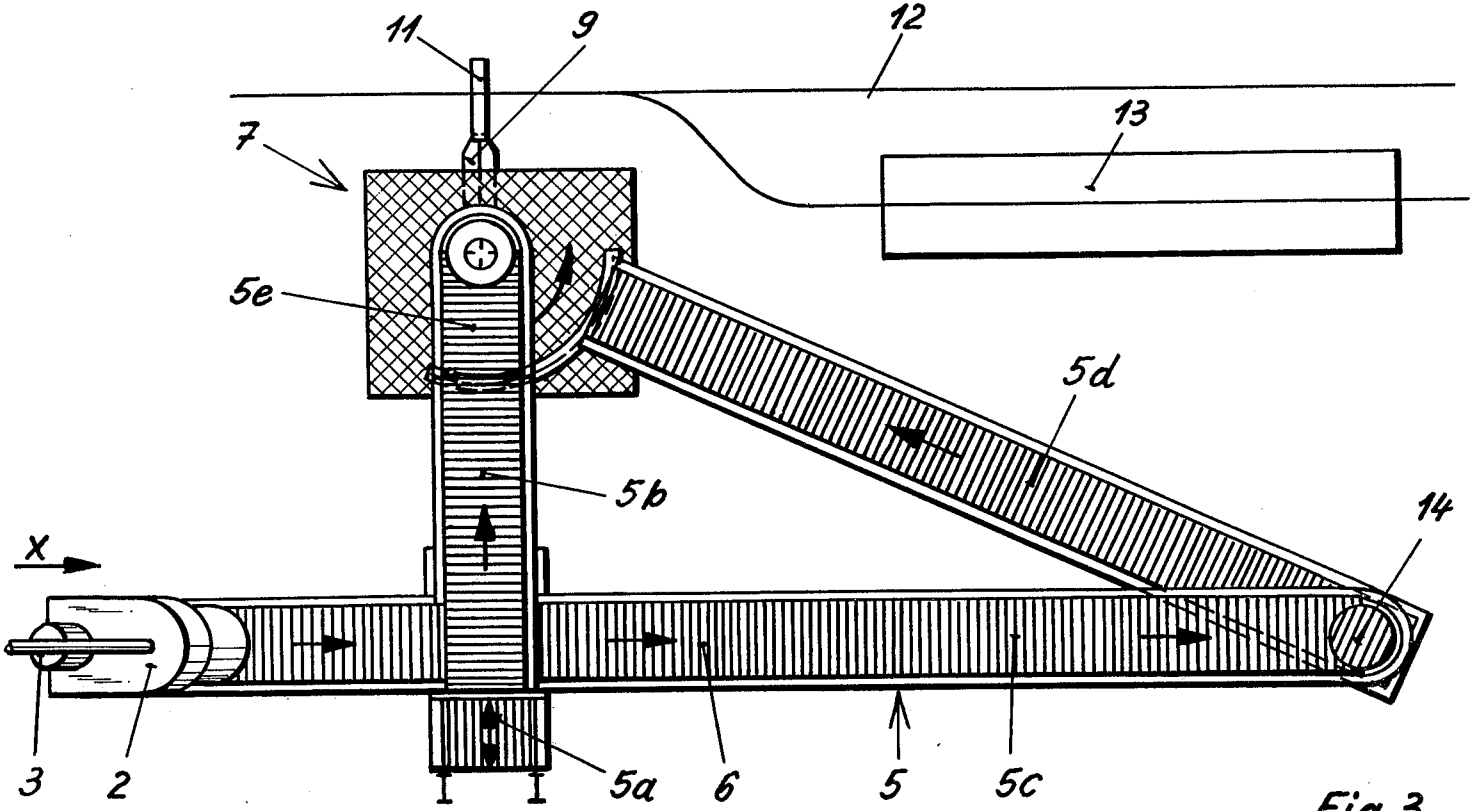
FIGS. 3 and 4 are plan views of two embodiments of air cooling conveyor arrangements in accordance with the invention, each having two alternative lengths of path.

Two lengths of path of the conveyor 5 are available in the embodiment of air cooling in accordance with the invention shown in FIG. 3. The conveyor 5 has a removable portion 5*a* which is located at a short distance downstream of the loop-forming device 2 which, as is illustrated, has been moved laterally out of the straight line of the conveyor. Consequently, in the region of the removable portion 5*a*, the loops 4 drop onto a conveyor portion 5*b* which is located at a lower level and which feeds the spread-out wire loops 4 along the shortest path to the coil-forming station 7 transversely of the original conveying direction. The coils 8 formed in the coil-forming station are either cooled slowly in the static air by the hook-type conveying means 12 (only shown diagrammatically) or are fed by the said conveying means to a heat-retaining chamber 13 in which they can be subjected to heat treatment and also to a very slow, controlled cooling process.

If the selectively removable portion 5*a* is not removed, the wire loops 4 are not conveyed onto the conveyor portion 5*b* but onto the conveyor portions 5*c* and 5*d* which are considerably longer and which correspondingly give rise to more intensive cooling. The wire loops are transferred from the conveyor portion 5*c* to the conveyor portion 5*d* by means of a fall-through opening 14 through which the loops 4 drop from the higher conveyor portion 5*c* onto the conveyor portion 5*d* which is located at a lower level. The conveying direction is also changed at the same time. A pivotable switch portion 5*e* which is selectively alignable with the various conveyor portions 5*b* and 5*d* is provided in the region of the coil-forming station 7.

Figure 4:
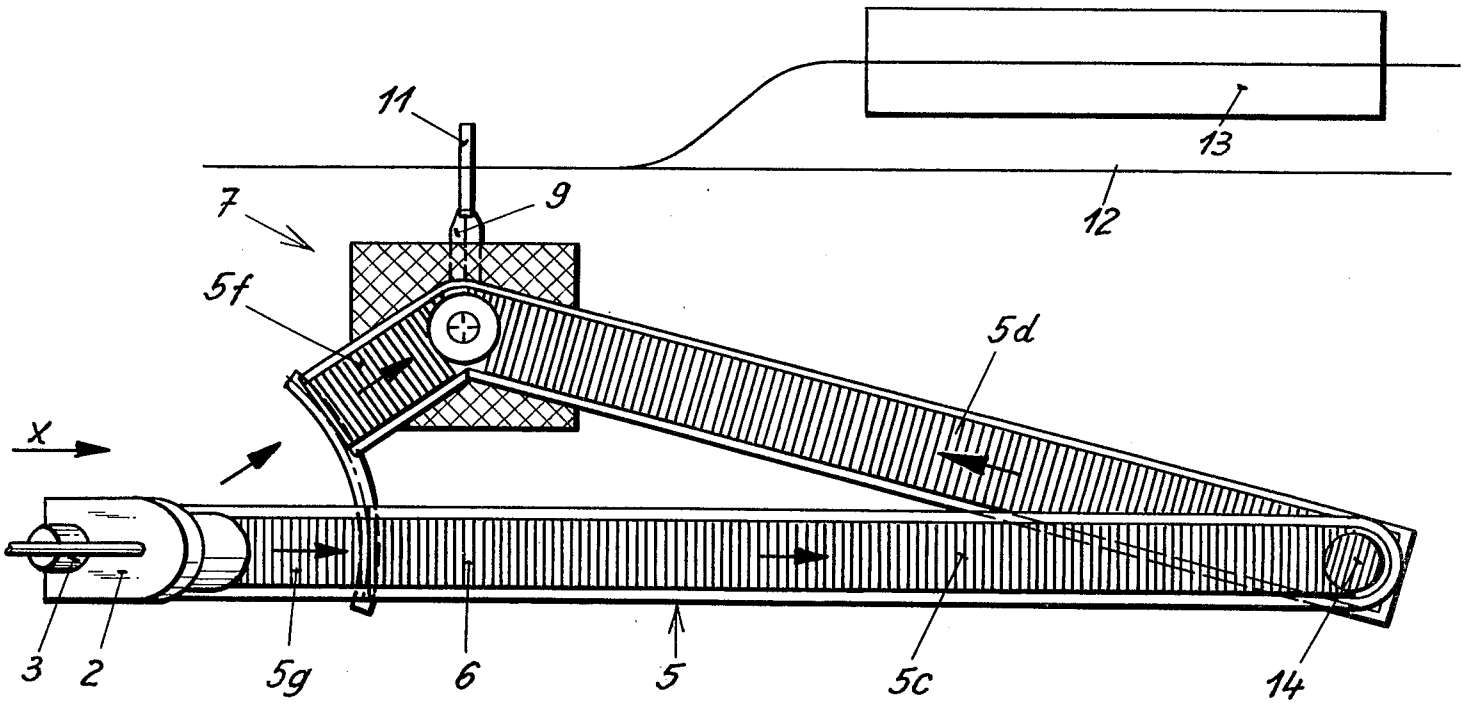

The embodiment of FIG. 4 differs essentially from the embodiment of FIG. 3 only in that a pivotable switch portion 5*g*, selectively alignable with various conveyor portions 5*c* or 5*f*, is arranged directly downstream of the loop-forming device 2, thus dispensing with the removable conveyor portion 5*a*.

Figure 5:
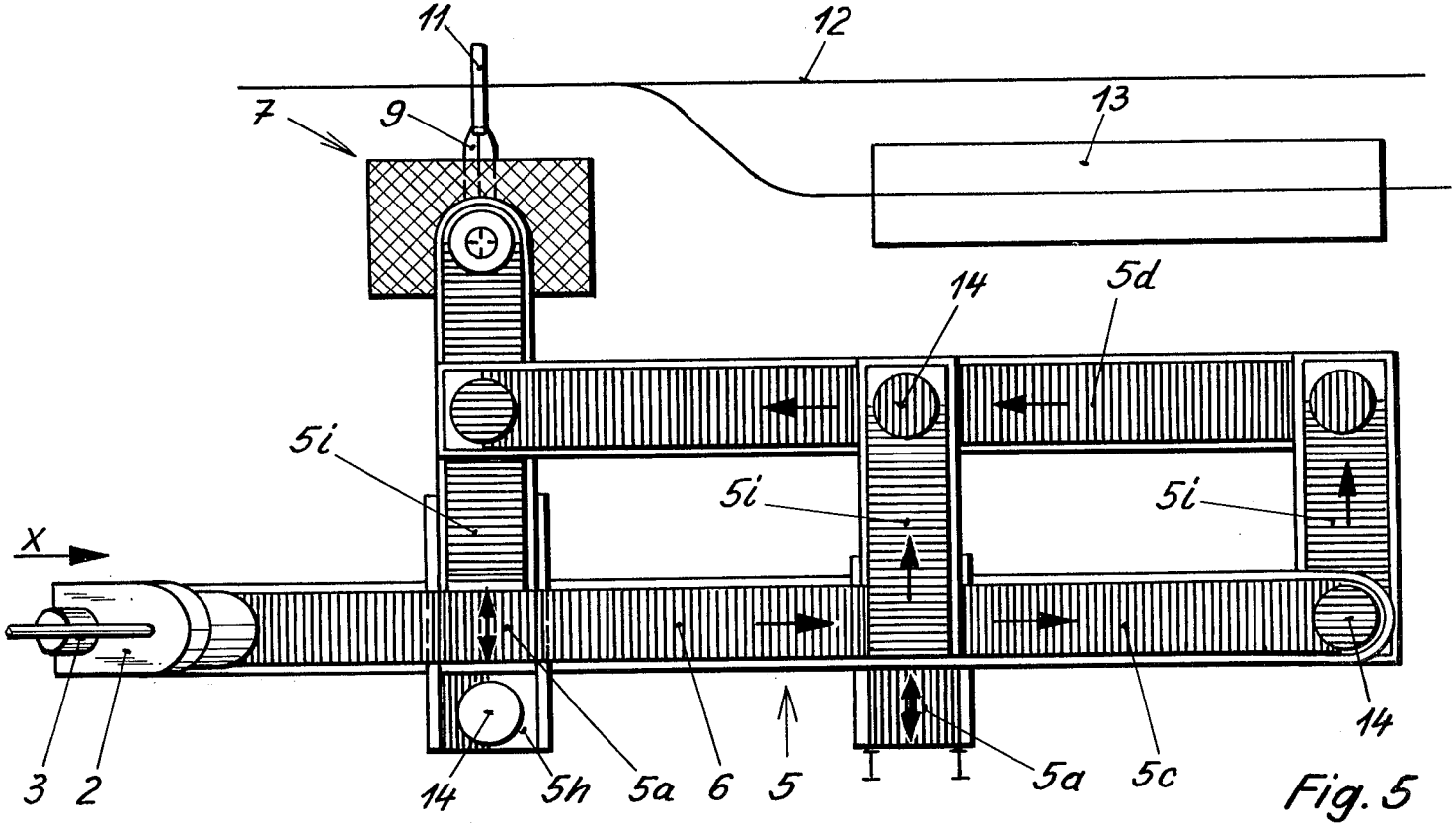
FIG. 5 is a plan view of an air cooling conveyor arrangement in accordance with the invention, having three alternative lengths of pipe.

The embodiment of FIG. 5 shows that it is quite possible to provide more than two different lengths of path (three in the present case). Two removable conveyor portions 5*a* are provided in the conveyor portion 5*c* leading rectilinearly away from the loop-forming device 2, that portion 5*a* which is nearer to the loop-forming device 2, being interchangeable with a conveyor portion 5*h* having a fall-through opening for the loops 4. Aternatively, this could apply to the second removable portion 5*a* which, however, corresponds to the embodiment of FIG. 3. A total of three transverse conveyor portions 5*i* can feed the loops 4 to the coil-forming station 7 either directly or by way of the conveyor portion 5*d*. In this embodiment the conveyor portion 5*d* extends parallel to the portion designated 5*c*.

In the foregoing specification we have set out certain preferred practices and embodiments of our invention, however, the invention may be otherwise embodied within the scope of the following claims.

We claim:

1. A cooling conveyor arrangement for the cooling of hot-rolled wire or wire rod, comprising a loop-forming device for depositing the wire or rod in spread-out, mutually overlapping loops, a single coil-forming station for collecting the loops, a conveyor having at least two branches of different lengths for conveying the loops between the loop-forming device and the coil-forming station while the loops cool and transfer means on said conveyor for guiding the loops selectively onto portions of different lengths of the conveyor.

2. A cooling arrangement as claimed in claim 1, in which the transfer means comprises a selectively removable conveyor portion which upon removal provides a fall-through opening for the loops and in which another conveyor portion is provided below the latter.

3. A cooling arrangement as claimed in claim 1 wherein the transfer means comprises a selectively exchangeable conveyor portion having a fall-through opening for the loops and in which another conveyor is provided below the latter.

4. A cooling arrangement as claimed in claim 1, in which the transfer portion comprises a pivotable switch portion which is selectively alignable with various other conveyor portions.

5. A cooling conveyor arrangement as claimed in claim 1 or 2 or 3 or 4 wherein the pivoting conveyor section pivots around the coil forming station into alignment with one of the at least two branches carrying the loops.

* * * * *

UNITED STATES PATENT AND TRADEMARK OFFICE

CERTIFICATE OF CORRECTION

PATENT NO. : 4,320,646

DATED : March 23, 1982

INVENTOR(S) : ALI BINDERNAGEL, ERNST O. BLOS and HANS BRAUER

It is certified that error appears in the above-identified patent and that said Letters Patent are hereby corrected as shown below:

On the title page, insert:

-- Foreign Application Priority Data

Aug. 13, 1979 (DE) Fed. of Germany ....2932729 --.

Signed and Sealed this

Nineteenth Day of October 1982

[SEAL]

*Attest:*

GERALD J. MOSSINGHOFF

*Attesting Officer*

*Commissioner of Patents and Trademarks*